US006616400B1

(12) United States Patent
Caponey

(10) Patent No.: US 6,616,400 B1
(45) Date of Patent: Sep. 9, 2003

(54) METHOD FOR HIGHLY EFFICIENT REFUSE REMOVAL FROM A CONSTRUCTION SITE

(76) Inventor: Victor J. Caponey, 176 Berry Dr., Greenville, SC (US) 29607

( * ) Notice: Subject to any disclaimer, the term of this patent is extended or adjusted under 35 U.S.C. 154(b) by 0 days.

(21) Appl. No.: 10/144,660

(22) Filed: May 22, 2002

(51) Int. Cl.[7] ..... B65F 9/00
(52) U.S. Cl. ..... 414/809; 414/341; 414/332
(58) Field of Search ..... 414/332, 389, 414/406, 419, 809, 340, 341

(56) References Cited

U.S. PATENT DOCUMENTS

| | | | | | |
|---|---|---|---|---|---|
| 1,878,994 | A | | 9/1932 | Abbe | |
| 2,411,263 | A | | 11/1946 | Guerin et al. | 214/113 |
| 2,468,326 | A | | 4/1949 | Gleason | 214/113 |
| 2,522,128 | A | | 9/1950 | Lehmann | 214/113 |
| 2,623,654 | A | | 12/1952 | Dunham | 214/701 |
| 2,822,949 | A | | 2/1958 | Sinclair | 214/701 |
| 2,968,411 | A | | 1/1961 | Jegge | 214/315 |
| 2,979,217 | A | | 4/1961 | Tomasovich | 214/701 |
| 3,318,486 | A | * | 5/1967 | Felix | 410/31 |
| 3,613,924 | A | * | 10/1971 | Monson | 414/420 |
| 3,701,443 | A | * | 10/1972 | Lely | 414/546 |
| 3,876,100 | A | | 4/1975 | Brudi et al. | 214/652 |
| 4,095,714 | A | | 6/1978 | Schuster | 214/620 |
| 4,143,782 | A | | 3/1979 | Dengler | 414/672 |
| 4,243,355 | A | | 1/1981 | Brudi et al. | 414/620 |
| 4,540,330 | A | * | 9/1985 | Taylor | 414/641 |
| 4,913,301 | A | * | 4/1990 | Pickler | 220/1 T |
| 4,921,389 | A | | 5/1990 | O'Daniel | 414/420 |
| 5,228,822 | A | | 7/1993 | Schrader | 414/421 |
| 5,281,073 | A | * | 1/1994 | Gesuale | 414/421 |
| 5,335,789 | A | * | 8/1994 | Taravella et al. | 206/518 |
| 5,586,616 | A | * | 12/1996 | Ksenych | 182/222 |
| 5,730,576 | A | | 3/1998 | O'Daniel | 414/421 |
| 5,888,043 | A | * | 3/1999 | Jatcko | 414/459 |
| 5,938,399 | A | | 8/1999 | Knutson | 414/722 |

* cited by examiner

*Primary Examiner*—Kathy Matecki
*Assistant Examiner*—Charles A. Fox
(74) *Attorney, Agent, or Firm*—Joseph T. Guy; Nexsen Pruet Jacobs & Pollard, LLC

(57) ABSTRACT

A method, and system, for refuse removal from a collection site. The method comprises transporting multiple containers in an inverted stack to the collection site. Engaging a first container of the multiple containers with a rotating fork lift truck. Lifting the first container from the inverted stack with the rotating fork lift truck. Rotating the first container with the rotating fork lift truck.

8 Claims, 7 Drawing Sheets

METHOD FOR HIGHLY EFFICIENT REFUSE REMOVAL FROM A CONSTRUCTION SITE

BACKGROUND OF THE INVENTION

The present invention relates to a method for efficiently removing refuse from a construction site, or other site of refuse generation, and to a system for accomplishing the method.

It is well known that refuse generation at a construction site is a burden. The expense associated with collecting the refuse at the construction site and transporting the refuse to a dumping site must be included in the total cost of construction. There is an ongoing effort to decrease the cost associated with removing refuse from a construction site.

The refuse is also unsightly during construction. The unsightly appearance is a particular problem in tract developments where multiple homes, or units, are being constructed during a short time frame. It is most common for a developer of a tract to desire initiating sales agreements prior to completion of the project and to allow units to be occupied prior to the completion of all of the housing units in the development. The unsightly accumulation of refuse is a detriment to the early sales, and early occupation, of tract homes.

There are presently two approaches to refuse collection and removal. One approach is the use of large containers, such as about 30 feet long, wherein the refuse is collected for removal. This approach has the advantage of being able to accumulate large amounts of refuse prior to being transported for dumping. The disadvantage of this method is the inability to locate the large containers in suitable locations. Tract developments, for example, may involve multiple homes, or units, being constructed at any given time. With large containers the location is always inconvenient for at least some of the homes being constructed. This requires the refuse to be collected and transported to the large container thereby creating a manpower burden. The transporting of refuse also greatly increases the likelihood of the refuse becoming scattered due to wind, or for other reasons. This increases the unsightly accumulation of refuse throughout the development.

The large containers are also a burden due to the weight. The large containers typically scar the roadbed upon which they are placed. This creates an additional repair item for the developer thereby increasing the total cost of the development.

In use, the large containers are delivered individually to a construction site. When full the large container is either hauled to a dumpsite by truck, leaving the construction site without a refuse container for a period of time, or an empty container is delivered and the full container removed. One disadvantage to the large containers is the inability to transport multiple containers. Each time the container is to be relocated a dedicated vehicle is required. It is well know that large vehicles, such as those used for transporting large containers, utilize large volumes of fuel. It is therefore desirable to limit the distance and number of trips for these large vehicles.

An alternate approach to the large containers is the use of a multiplicity of small containers. These containers are frequently referred to as dumpsters. The small containers have the advantage of being more easily located in convenient locations. The use of multiple locations reduces the burden associated with transporting refuse to a centrally located large container. The small containers also are less harmful to the roadbed upon which they rest even though scarring still occurs. Small containers have disadvantages that have not yet been resolved.

Small containers contain less refuse than a large container and therefore must be dumped more frequently. It would be obvious that a given construction site would require multiple small containers to contain the refuse of one large container. Therefore, the burden of dumping the containers is magnified. The time required to dump each small container is not substantially less than the time required to deliver an empty large container and remove a full large container. In practice, small containers are dumped by a dedicated vehicle capable of lifting the small container upward and in an arc towards the rear of the vehicle wherein the refuse is dumped in a covered truck bed. When the truck bed is full the vehicle then drives to a dumpsite. The dedicated vehicle is typically not suitable for other uses in a construction site. The requirement of a dedicated vehicle is an obvious burden to a developer. Therefore, the benefit of having conveniently located containers is obliterated by the cost associated with dumping the multiple small containers.

Yet another burden is encountered when the small containers are to be relocated. Relocation occurs at the start and completion of a development project but also during the project as housing units are started and completed in an ongoing fashion. The size of the small containers still requires a dedicated vehicle for transport. In some cases, a truck and trailer may be able to transport two or three small containers but this is still an unnecessary burden.

There has been a long felt desire for a method, and system, of removing refuse from a construction site which is efficient, with respect to manpower and cost, and convenient yet does not require dedicated vehicles. This desire has not been met prior to the present invention. A novel and unique approach to a long felt problem is described herein.

BRIEF SUMMARY OF THE INVENTION

Hence, it is object of the present invention to provide a method for removing refuse from a construction site using small localized containers while mitigating the burden associated with dumping many small containers.

It is another object of the present invention to provide a method, and system, for removing refuse from a construction site. The method, and system, utilizes containers optimised for increased productivity at the both construction site and in the dumping operation.

These and other advantages, as would be realised to one of ordinary skill in the art, are provided in a method for refuse removal from a collection site. The method comprises transporting multiple containers in an inverted stack to the collection site. Engaging a first container of the multiple containers with a rotating fork lift truck. Lifting the first container from the inverted stack with the rotating fork lift truck. Rotating the first container with the rotating fork lift truck. Lowering the first container to a collection surface and collecting the refuse in the first container;

lifting said first container with said rotating fork lift truck and inverting said first container such that said refuse enters a collection bin of a collection truck.

Yet another advantage is provided in a system for refuse removal from a collection site. The system comprises stackable containers wherein each stackable container of the stackable containers comprises a base comprising multiple sides. A Trapezoidal wall is provided for each side of the base wherein the trapezoidal wall comprises a first face, a second face parallel to and longer than the first face and two side faces wherein the side faces are not parallel. The first face is attached to one side of the base. Adjacent side faces are attached to each other to form a truncated pyramidal structure The container has at least one fork channel attached to the base. A rotating fork lift truck, comprising at least one fork capable of being received by the fork channel, is provided for lifting and inverting the container for stacking.

Yet another advantage is provided in an invertably stackable refuse container. The container comprises a base comprising multiple sides and a trapezoidal wall for each side of the base. Each trapezoidal wall comprises a first face, a second face parallel to and longer than the first face and two side faces. The side faces are not parallel. Each first face is attached to one side of the base. Adjacent side faces are attached to each other to form a truncated pyramidal structure. A fork channel is attached to said base.

DETAILED DESCRIPTION OF THE INVENTION

The inventors of the present application have developed, through diligent research, a method, and system, for efficiently removing refuse from a construction site.

The invention will be described with reference to the figures forming a part of the present application. In the various figures similar elements are numbered accordingly.

Figure 1:
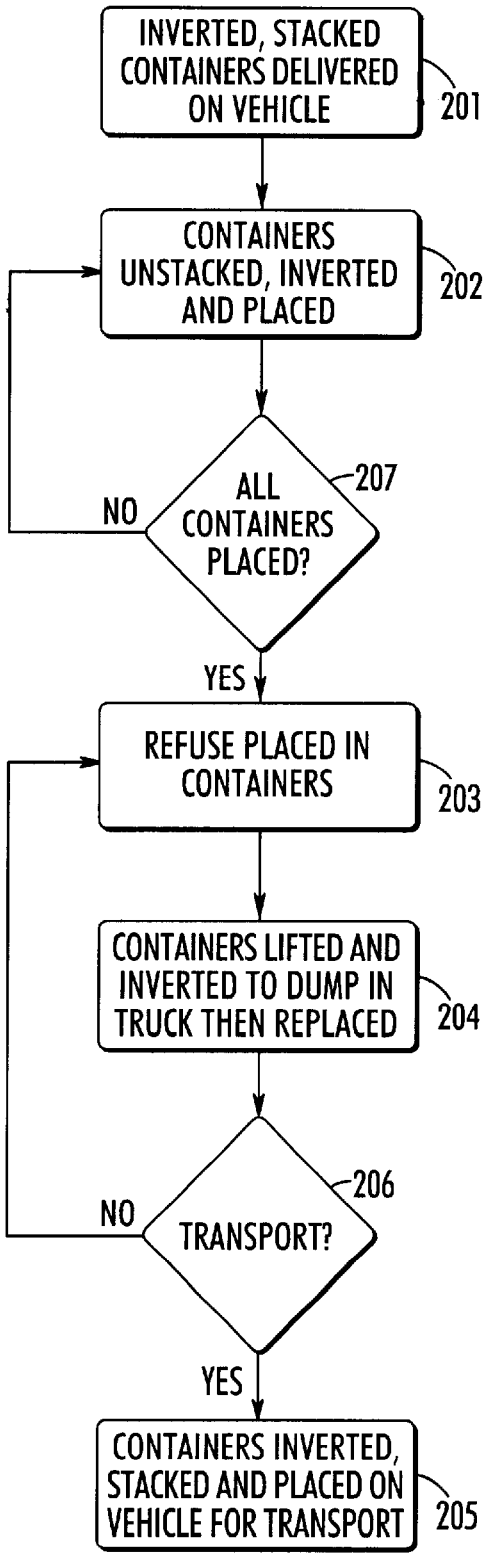
FIG. 1 is a flow chart illustrating the steps of a preferred embodiment of the present invention.

FIG. 1 is a representative flow diagram detailing the steps of the present invention. The containers are delivered, preferably in an inverted stack, at 201. The advantages of delivering the containers in an inverted stack will be more apparent upon further detailed descriptions provided herein. Upon delivery the uppermost container is lifted from the stack, rotated and placed in the desired location as indicated at 202. This is repeated, at 207, until the desired number of containers is placed in the desired locations. Refuse is then added to the container, at 203, at a frequency determined by the location and work occurring at the location.

When it is desirable to empty the containers, the containers are lifted by a rotating fork lift truck and inverted to dump the contents into a conventional dump truck for transport at 204. It would be apparent that rotating fork lift trucks and dump trucks are commonly employed in construction and therefore a dedicated vehicle is not necessary. This represents an improvement over the art in both cost and convenience.

After being dumped the container is returned to the collection site or designated for transport at 206. Refuse can again be added to the container at 203. If the use of the container at the site is discontinued the container is then relocated wherein a particularly advantage of the present invention is realized. In transporting, the container is inverted and stacked on a transport vehicle at 205. A particular feature of the present invention is the ability to stack inverted containers for transport. The transport vehicle can be a flat bed truck or trailer both of which are commonly employed in construction. This ability to invert and stack the containers eliminates the need for a dedicated vehicle and greatly increases the number of containers transported at a given time. The ability to utilize rotating fork lift trucks, dump trucks and flat bed trucks or trailers, greatly increases the efficiency associated with refuse removal from a construction site or other site of refuse generation or collection.

Figure 2:
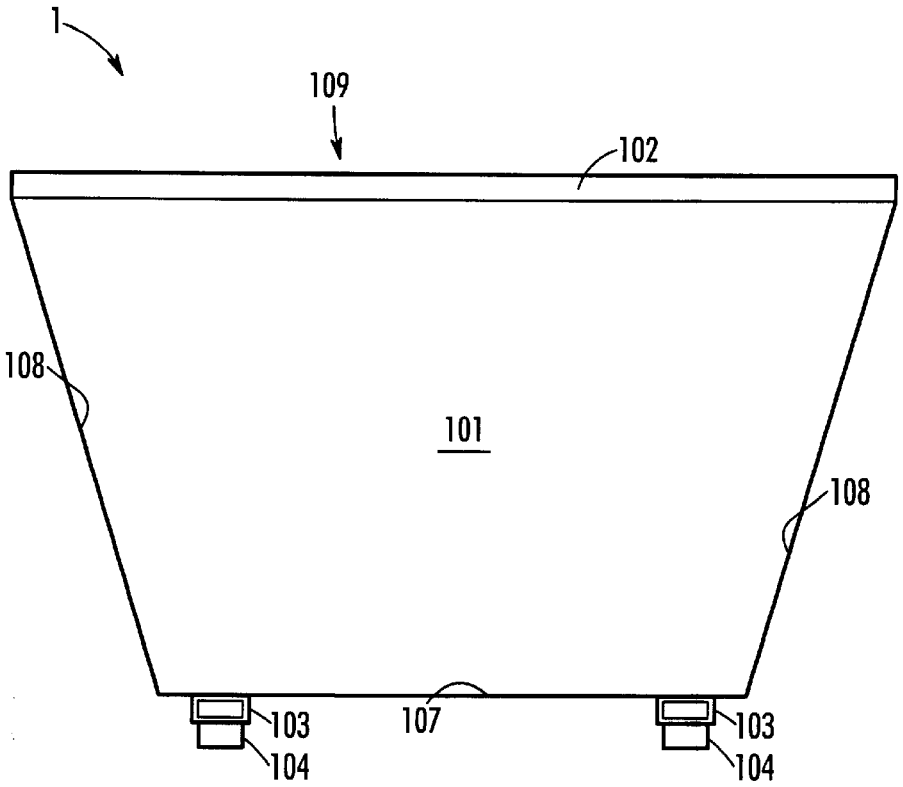
FIG. 2 is a side view of a preferred container of the present invention.
Figure 3:
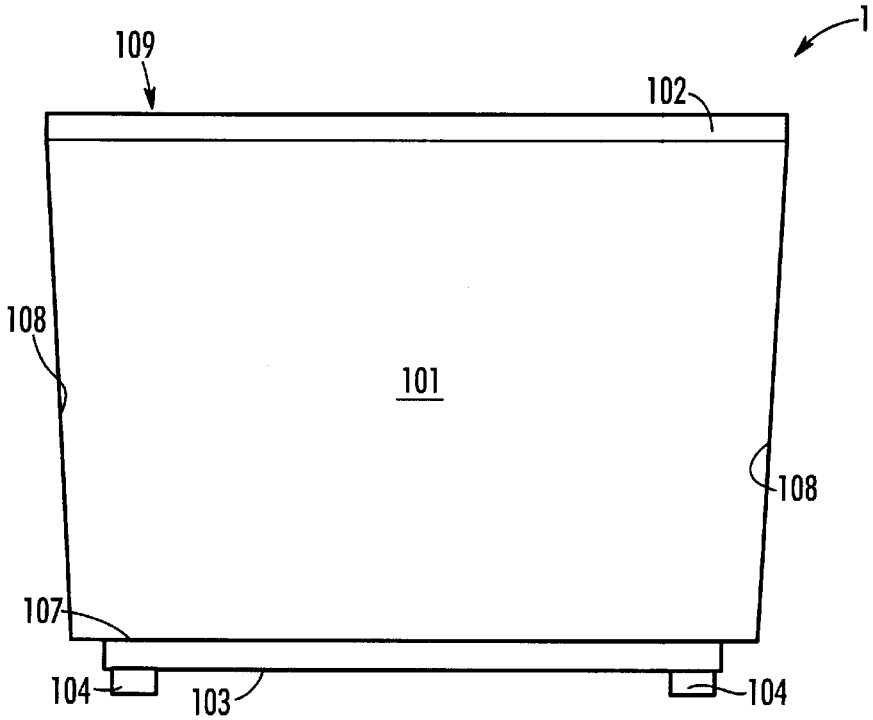
FIG. 3 is a front view of the preferred container of FIG. 2.
Figure 4:
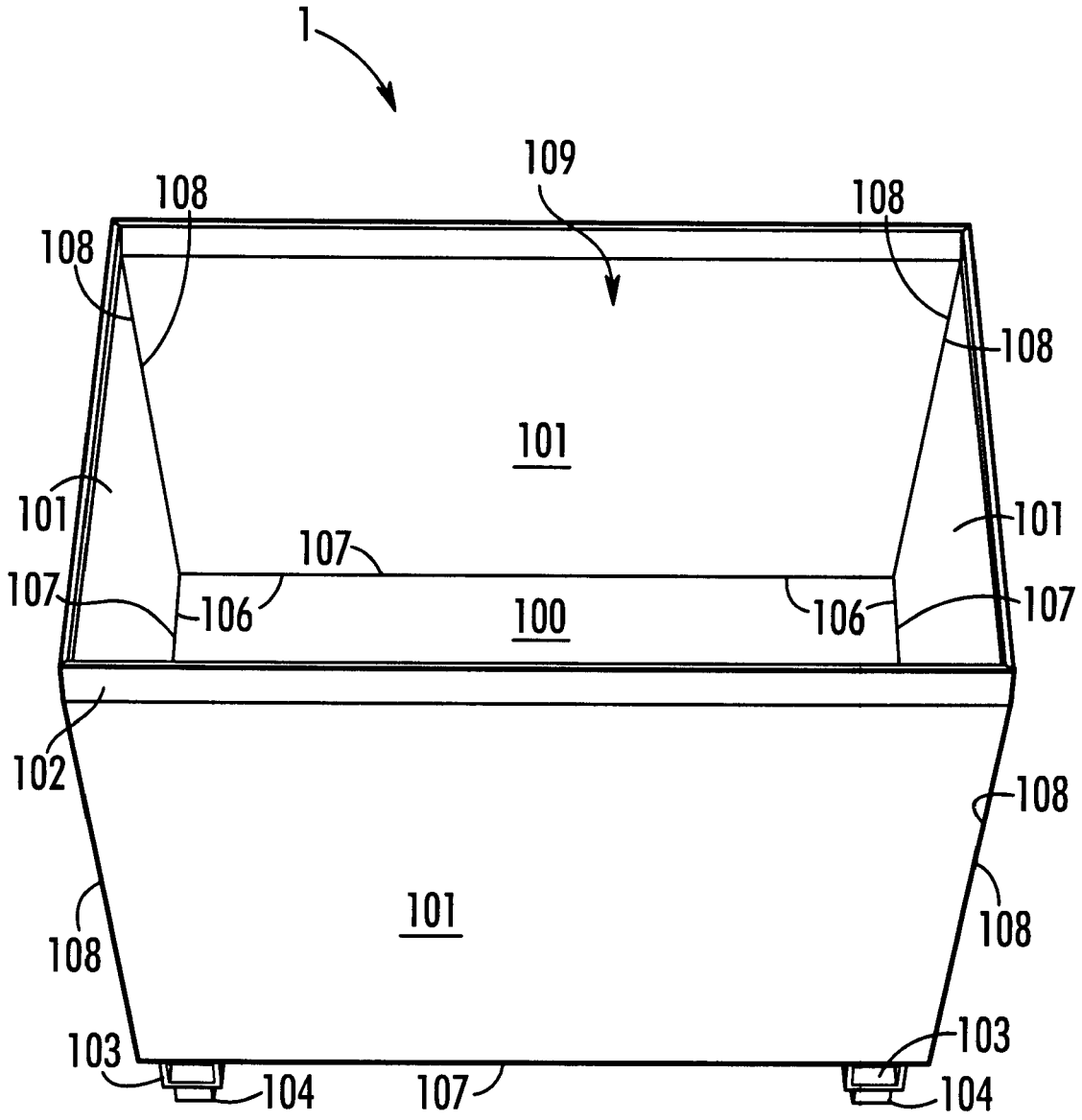
FIG. 4 is a perspective view of the preferred container of FIGS. 1–3.

A preferred container is illustrated in FIGS. 2–4. FIG. 2 is a side view of a preferred container. FIG. 3 is a front view and FIG. 4 is a perspective view. The preferred container, 1, is a truncated pyramidal in shape and most preferably truncated rectangular pyramidal in shape. Most preferably the container is truncated square pyramidal in shape. The term "truncated pyramidal" is defined, for the purposes of the present invention, to indicate a shape comprising a closed base, 100. Each face, 106, of the base, 100, is attached to the shorter face, 107, of the parallel faces of a trapezoidal wall, 101. The wall is most preferably in the shape of a trapezoid with two parallel faces and two non-parallel faces. More preferably the wall is in the shape of an isosceles trapezoid. The non-parallel faces, 108, of adjacent trapezoidal walls, 101, are attached to each other such that the container forms an outwardly diverging encasement with an open end, 109. The open end, 109, is larger in size than the base, 100, and preferably substantially the same geometric shape. The trapezoidal walls may all be the same size or they may be different. Most preferably, opposite trapezoidal walls are substantially identical in shape and size.

Figure 5:
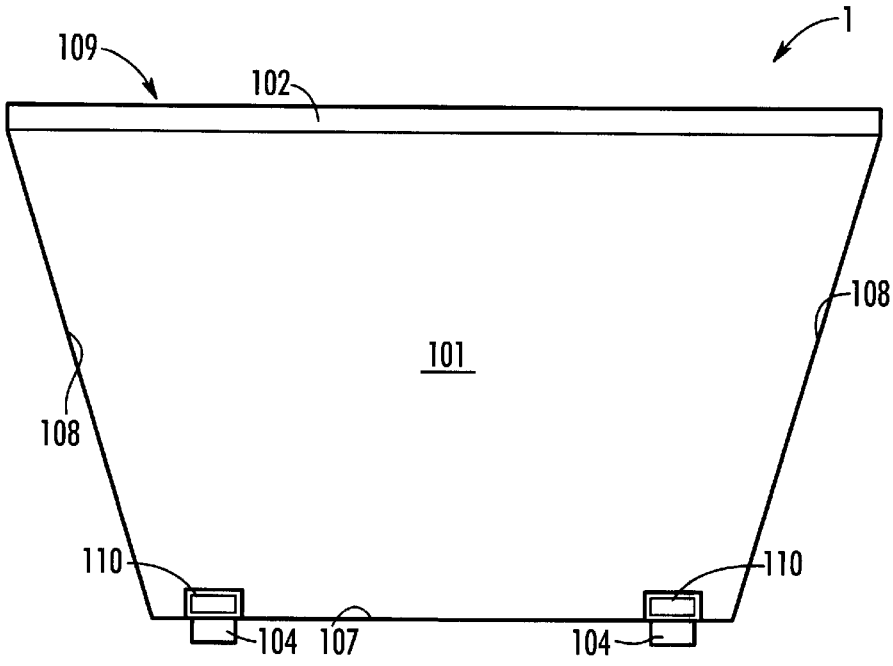
FIG. 5 is a side view of an alternate preferred container of the present invention.

Attached to the base, 100, preferably outside the container, 1, is at least one fork channel, 103, which receives the forks of a rotating fork lift truck. It is most preferred that the rotating fork lift truck have two forks and that the container have two fork channels wherein each fork channel receives one fork. A single fork channel of sufficient width to receive two forks is suitable but less desirable. The translation of the container from side to side during rotation is minimized with two forks being received by two fork channels. A fork channel can be within the container as illustrated at 110 of FIG. 5. While an internal fork channel, 110, is within the scope of the present invention they are less desired due to the increased cost of manufacture. Spacers, 104, are preferably secured to the bottom of the container to prohibit scarring of the surface upon which the container is placed. The spacers also insure adequate separation between stacked containers as will be realized after further discussion. The spacers are preferably manufactured from hard vulcanised rubber or a cellulose product such as wood. A spacer formed from vulcanised rubber is preferred.

Circumventing the open end, 109, is a preferred support ring, 102. The support ring strengthens the walls at the opening and provides structural stability to the container. The support ring, 102, also provides a rest when the containers are inverted and stacked.

The container size is chosen through diligent research to optimise the amount of material which can be contained therein while still offering the advantages of optimum transport. The open end of the container is preferably the largest as realized from the descriptions herein. A particularly preferred container is rectangular with sides of at least about 4 feet long to no more than about 7 feet long. A particularly preferred container is a rectangular shape at the open end with a width of about 5 feet long and a length of about 6 feet long. It is most preferred that the front, defined as the side which faces the rotating fork lift truck is longer than the side. The base is preferably rectangular and at least about 3 feet long on each side to no more than about 5 feet long on each side. In a particularly preferred embodiment the base is about 4 feet wide by about 4 feet 8 inches wide. The height of the container is chosen to optimise the material the container can hold while still allowing the container to be small enough to be easily transported. The height is preferably at least about 3 feet high to no more than about 6 feet high. A container which is about 4 feet in height is most preferred.

Figure 6:
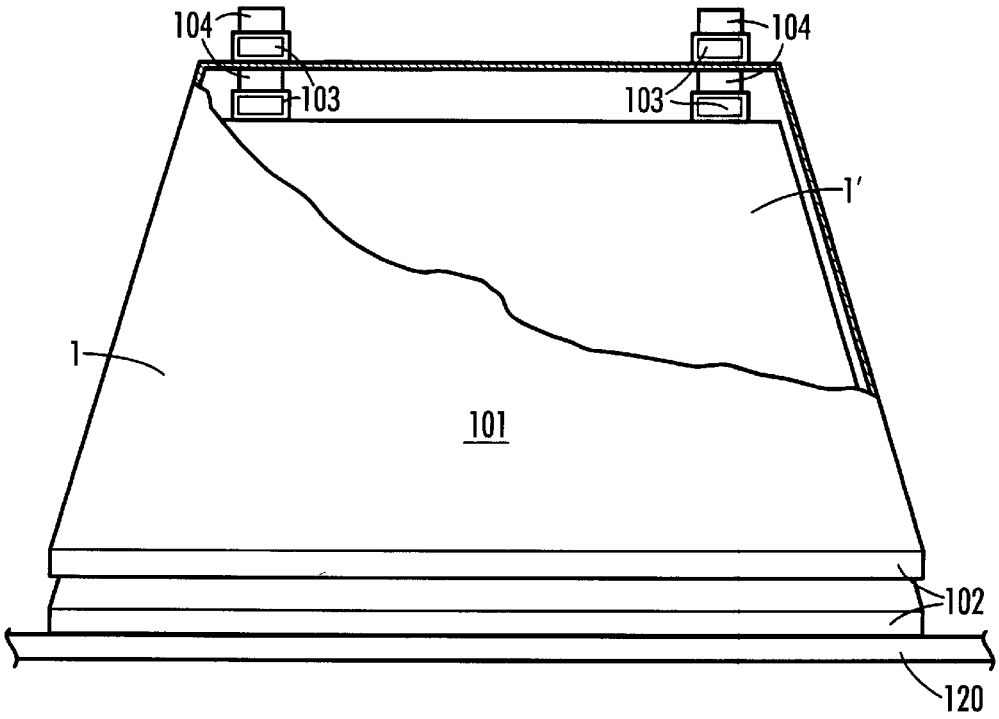
FIG. 6 is a partial cutaway view illustrating a particular feature of the present invention.

A partial cutaway side-view of stacked containers is provided in FIG. 6. In FIG. 6, the outermost container, 1, is shown in partial cutaway view. An inner container, 1', is shown as received by the outermost container. For the purposes of transport, or storage, an inner container, 1', is inverted and placed on the open end upon a surface, 120. The surface can be a transport bed, such as a truck bed or trailer, or a storage pad. An outermost container, 1, is lifted, inverted, and lowered onto the inner container, 1', with the inner container being received by the outermost container. Additional containers can then be lifted, inverted and placed on the stack of containers to form a nested stack of containers. This allows multiple containers to be shipped or stored while utilizing a foot print of a single container. The outer container, 1, preferably rests on the spacer, 104, of the inner container. In a particularly preferred embodiment each subsequent container in a nested stack rest on the spacer of the container received therein. In a particularly preferred embodiment the support ring, 102, of each subsequent container forms a stop prohibiting the inner container from entering far enough into the outer container to become lodged. This eliminates problems associated with jamming in the event of a catastrophic loss of a spacer or in the event of a spacer compressing under the weight of stacked containers. In a preferred embodiment, the support ring of each subsequent container is in contact and the spacer is slightly compressed between containers and biased towards expanding to separate the containers. This preferred embodiment decreases the movement during transport and decreases the noise associated with containers vibrating and contacting each other during transport.

Figure 7:
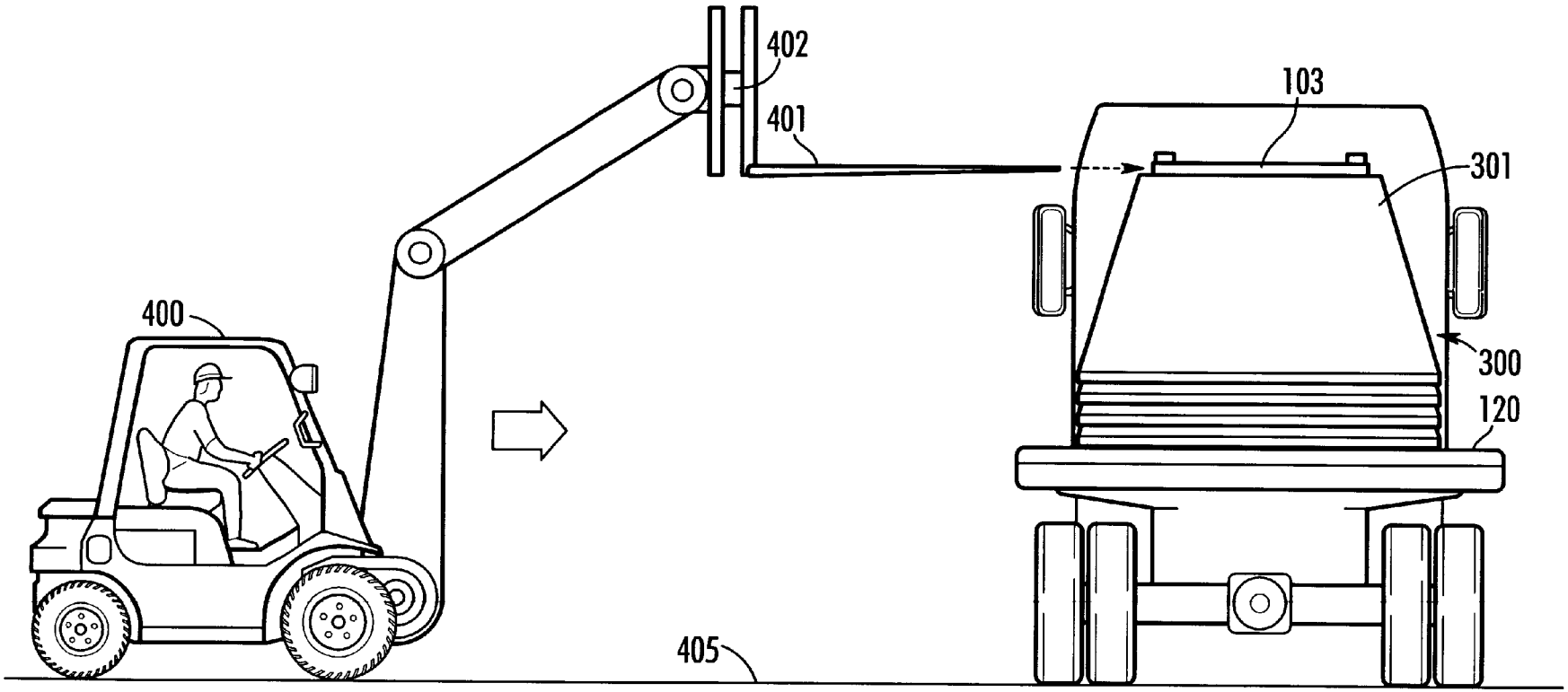
FIG. 7 is a diagrammatic representation of a particular advantage of the present invention.

The removal of the containers from a stack will be described with reference to FIG. 7. In FIG. 7, a rotating fork lift truck, 400, moves towards a surface, 120, such as a truck bed. The forks, 401, are aligned with and slidably received by the fork channels, 103, of the outermost container, 301, of the stack of nested containers, 300. After the forks, 401, are received by the fork channels, 103, the actuators of the rotating fork lift truck are manipulated to lift the uppermost container, 301, from the stack of nested containers, 300. The rotating fork lift truck, 400, then reverses until the uppermost container, 301, is clear of any obstacle. The forks, 401, are then rotated by a rotation mechanism, 402, until the container is inverted with the fork channels down. The forks are lowered until the container is placed on the ground, or alternate surface, 405. The rotating fork lift truck then reverses thereby slidably disengaging the forks from the fork channels.

Figure 8:
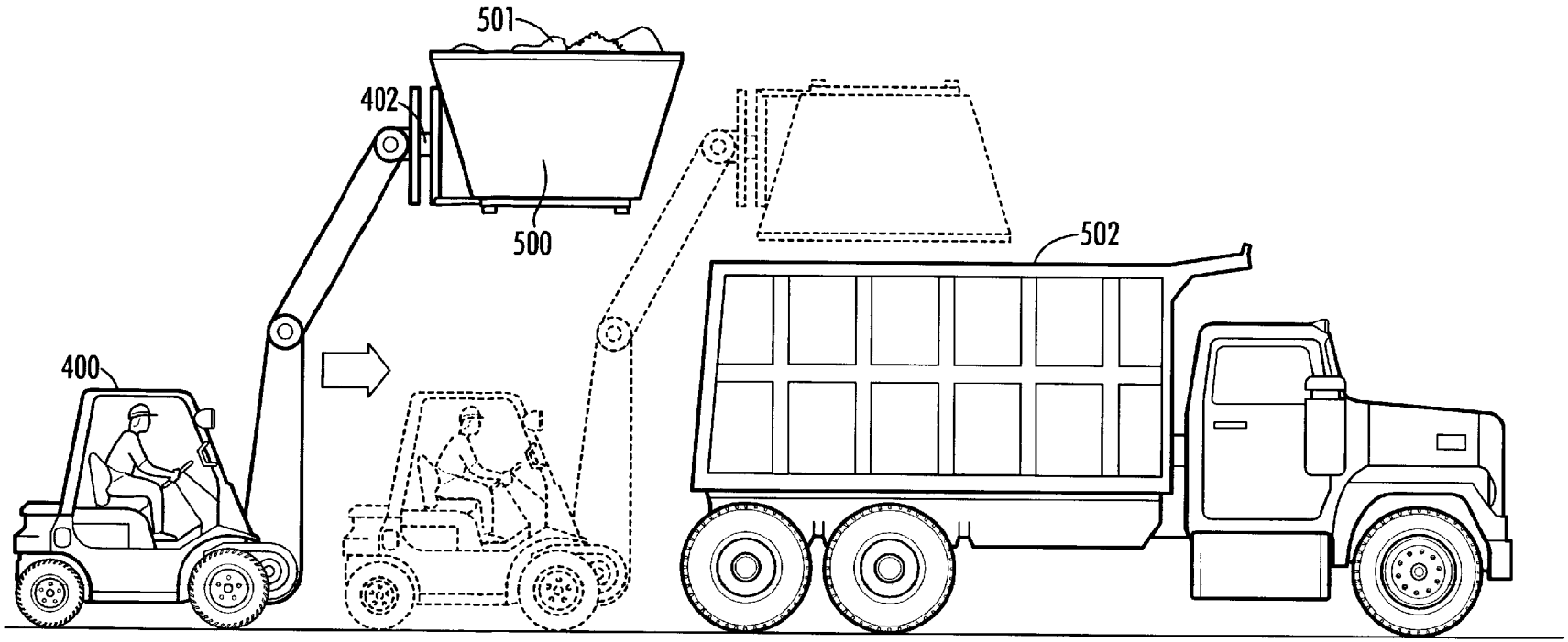
FIG. 8 is a diagrammatic representation of a particular advantage of the present invention.

Dumping of the containers will be described with reference to FIG. 8. In FIG. 8 a container, 500, comprising refuse, 501, is lifted by the forks of a rotating fork lift truck, 400. The rotating fork lift truck then moves to a position wherein the container, 500, is over the bed, 502, of a dump truck. The rotating mechanism, 402, is actuated to rotate the container to an inverted position wherein the refuse, 501, falls into the bed, 502. After the refuse has been dumped the container is inverted, the rotatable fork lift truck reverses and the container is lowered and placed in the desired position.

The walls, and base, are preferably manufactured from metal. The walls, and base may be substantially planar or they may be corrugated to increase the strength of the container. Support ribs may also be incorporated in regions of the container without departing from the scope of the present invention as would be readily apparent to one of ordinary skill in the art.

Figure 9:
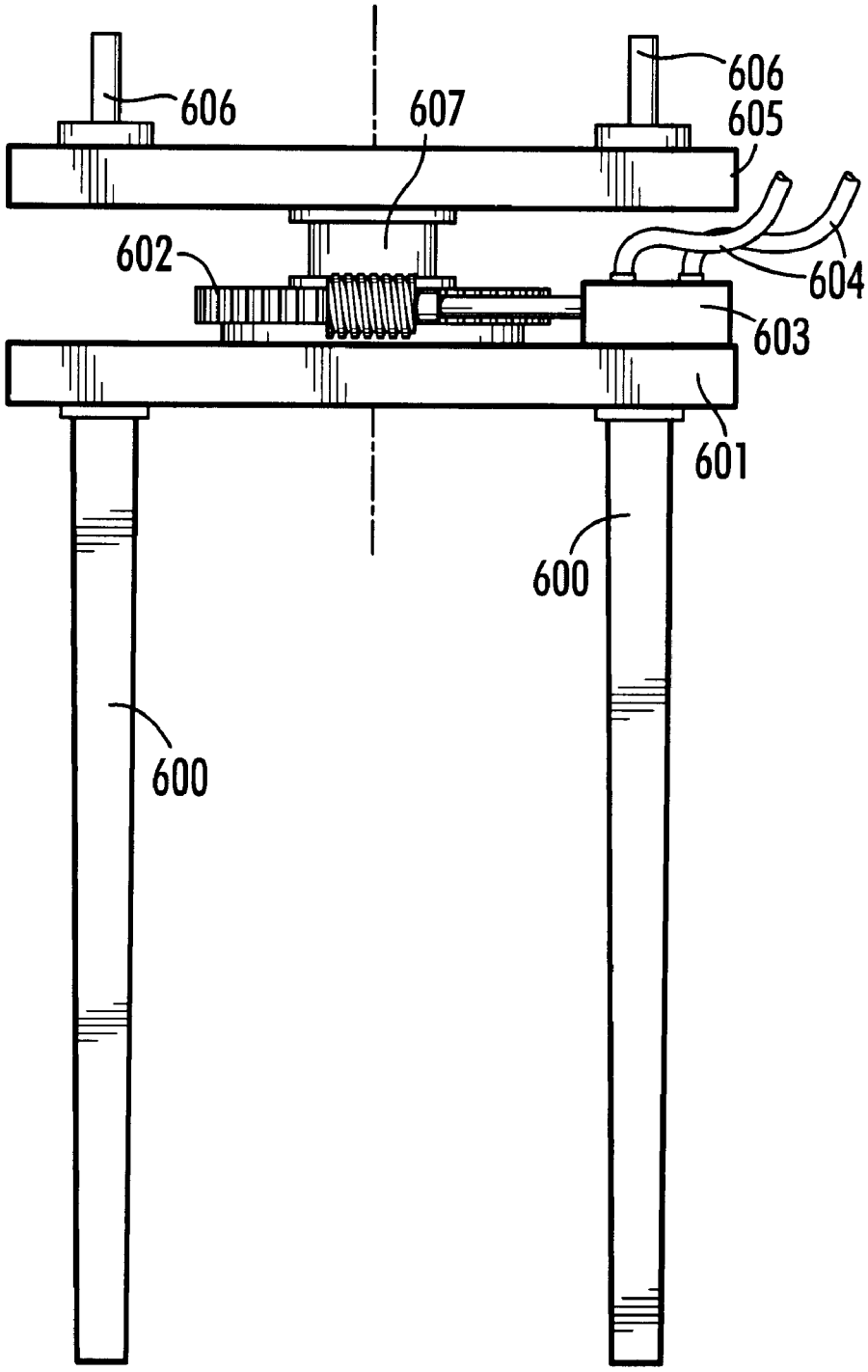
FIG. 9 is a preferred embodiment illustrated in partial view.

Rotating fork lift trucks are available commercially. For the purposes of the present invention the axis of rotation is parallel to the forks and the rotation involves minimal translation, such as less than 6 inches, of the forks. A particularly preferred embodiment utilizes a hydraulically activated worm gear rotatably engaged with a round gear secured to the forks. A preferred embodiment is illustrated in partial view in FIG. 9. In FIG. 9, the forks, 600, are attached to a fork plate, 601. A round gear, 602, is secured to the fork plate, 601, and engaged with a hydraulically activated worm gear mechanism, 603. The hydraulically activated worm gear rotates clockwise, or counter-clockwise depending on the direction of hydraulic fluid flow in the hydraulic lines, 604. The hydraulically activated worm gear is secured to a lift mechanism, 605, which is raised and lowered by lift arms, 606, of the lift truck. The round gear, 602, and fork plate, 601, are rotatably attached to the lift mechanism, 605. It is preferred that the fork plate be attached to the lift mechanism by an axle, 607, or suitable rotatable attachment. The rotating fork mechanism can involve gears as described in U.S. Pat. Nos. 3,876,100, 2,979,217 and 1,878,994; chain and sprocket mechanisms as described in U.S. Pat. Nos. 4,921,389 and 2,411,263; bearing hub assemblies as described in U.S. Pat. No. 4,143,782; actuator piston mechanisms as described in U.S. Pat. Nos. 5,730,576 and 4,095,714 and combinations thereof such as described in U.S. Pat. Nos. 4,243,355 and 2,822,949 all of which are incorporated herein by reference thereto. A skid steer loader is particularly preferred as described in U.S. Pat. No. 5,938,399 incorporated herein by reference thereto.

The invention has been described with particular emphasis on the preferred embodiments. It would be realized from the teachings herein that other embodiments, alterations, and configurations could be employed without departing from the scope of the invention which is more specifically set forth in the claims which are appended hereto.

What is claimed is:

1. A method for refuse removal from a collection site comprising:

transporting multiple containers in an inverted stack to said collection site;

engaging a first container of said multiple containers with a rotating fork lift truck;

lifting said first container from said inverted stack with said rotating fork lift truck;

rotating said first container with said rotating fork lift truck;

lowering said first container to a collection surface;

collecting said refuse in said first container;

lifting said first container with said rotating fork lift truck and inverting said first container such that said refuse enters a collection bin of a collection truck.

2. The method for refuse removal from a collection site of claim 1 further comprising:

inverting said first container and placing said first container on said inverted stack.

3. The method for refuse removal from a collection site of claim 1 wherein said first container comprises fork channels.

4. The method for refuse removal of claim 1 wherein said first container comprises spacers.

5. The method for refuse removal of claim 1 wherein said first container comprises a base.

6. The method for refuse removal of claim 5 wherein said first container comprises a trapezoidal wall for each side of said base wherein said trapezoidal wall comprises a first face, a second face parallel to and longer than said first face and two side faces wherein said side faces are not parallel and wherein each said first face is attached to one said side of said base and adjacent said side faces are attached to each other to form a truncated pyramidal structure.

7. The method for refuse removal of claim 1 wherein said rotating fork lift truck comprises a hydraulically actuated rotation mechanism.

8. The method for refuse removal of claim 7 wherein said hydraulically actuated rotation mechanism comprises a worm gear in rotatable communication with a round gear.

* * * * *

US006616400C1

(12) EX PARTE REEXAMINATION CERTIFICATE (8360th)

United States Patent
Caponey

(10) Number: US 6,616,400 C1
(45) Certificate Issued: Jun. 28, 2011

(54) METHOD FOR HIGHLY EFFICIENT REFUSE REMOVAL FROM A CONSTRUCTION SITE

(76) Inventor: Victor J. Caponey, Greenville, SC (US)

Reexamination Request:
No. 90/008,963, Jan. 30, 2008

Reexamination Certificate for:

| | |
|---|---|
| Patent No.: | **6,616,400** |
| Issued: | **Sep. 9, 2003** |
| Appl. No.: | **10/144,660** |
| Filed: | **May 22, 2002** |

(51) Int. Cl.
*B65F 1/12* (2006.01)
*B65F 9/00* (2006.01)

(52) U.S. Cl. ..... 414/809; 414/332; 414/341
(58) Field of Classification Search ..... None
See application file for complete search history.

(56) References Cited

U.S. PATENT DOCUMENTS

| | | | | |
|---|---|---|---|---|
| 1,878,994 | A | | 9/1932 | Abbe |
| 2,411,263 | A | | 11/1946 | Guerin et al. |
| 2,466,326 | A | | 4/1949 | Gleason |
| 2,522,128 | A | | 9/1950 | Lehmann |
| 2,623,654 | A | | 12/1952 | Dunham |
| 2,822,949 | A | | 2/1958 | Sinclair |
| 2,968,411 | A | | 1/1961 | Jegge |
| 2,979,217 | A | | 4/1961 | Tomasovich |
| 3,318,486 | A | | 5/1967 | Felix |
| 3,613,924 | A | | 10/1971 | Monson |
| 3,701,443 | A | | 10/1972 | Lely |
| 3,876,100 | A | | 4/1975 | Brudi et al. |
| 4,095,714 | A | | 6/1978 | Schuster |
| 4,143,782 | A | | 3/1979 | Dengler |
| 4,243,355 | A | | 1/1981 | Brudi et al. |
| 4,540,330 | A | | 9/1985 | Taylor |
| 4,662,669 | A | | 5/1987 | Erickson et al. ..... 294/68.27 |
| 4,913,301 | A | | 4/1990 | Pickler |
| 4,921,389 | A | | 5/1990 | O'Daniel |
| 5,228,822 | A | | 7/1993 | Schrader |
| 5,281,073 | A | * | 1/1994 | Gesuale ..... 414/421 |
| 5,335,789 | A | | 8/1994 | Taravella et al. |
| 5,586,616 | A | | 12/1996 | Ksenych |
| 5,730,576 | A | | 3/1998 | O'Daniel |
| 5,829,616 | A | | 11/1998 | Daniel et al. |
| 5,888,043 | A | | 3/1999 | Jatcko |
| 5,938,399 | A | | 8/1999 | Knutson |

OTHER PUBLICATIONS

"Recycling Sub Offers Curbside Service," Eight Penny news/JLC Oct. 1995.
"High–Tech Customer Requires State–of–the–Art Job–Site Recycling," C & D Debris Recycling, Mar./Apr. 1997.

* cited by examiner

*Primary Examiner*—Peter C. English

(57) ABSTRACT

A method, and system, for refuse removal from a collection site. The method comprises transporting multiple containers in an inverted stack to the collection site. Engaging a first container of the multiple containers with a rotating fork lift truck. Lifting the first container from the inverted stack with the rotating fork lift truck. Rotating the first container with the rotating fork lift truck.

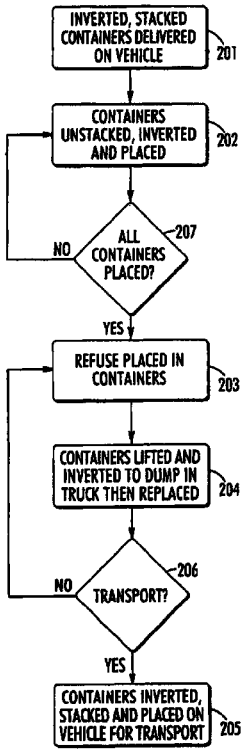

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-8 are cancelled.

* * * * *